US005867952A

United States Patent [19]

Takayoshi et al.

[11] Patent Number: 5,867,952

[45] Date of Patent: Feb. 9, 1999

[54] ASEISMIC SUPPORT STRUCTURE

[75] Inventors: Junji Takayoshi, Ohtsu; Katsushi Tanaka, Ohmihachiman; Takeshi Tsukamoto, Ohtsu, all of Japan

[73] Assignee: International Business Machines Corporation, Armonk, N.Y.

[21] Appl. No.: 698,832

[22] Filed: Aug. 16, 1996

[30] Foreign Application Priority Data

Aug. 17, 1995 [JP] Japan ..... 7-209551

[51] Int. Cl.[6] ..... E02D 27/34; E04B 1/98; E04H 9/02

[52] U.S. Cl. ..... 52/167.5; 52/167.4; 52/167.6; 248/638; 248/636

[58] Field of Search ..... 52/167.5, 167.4, 52/167.6; 248/638, 636

[56] References Cited

U.S. PATENT DOCUMENTS

| | | | |
|---|---|---|---|
| 4,711,423 | 12/1987 | Popper | 248/638 X |
| 4,805,359 | 2/1989 | Miyake et al. | 52/167.6 |
| 5,040,764 | 8/1991 | Dubois | 248/638 X |
| 5,308,036 | 5/1994 | Olson et al. | 248/638 |
| 5,366,200 | 11/1994 | Scura | 248/638 X |
| 5,520,029 | 5/1996 | Savkar | 248/638 X |

*Primary Examiner*—Carl D. Friedman
*Assistant Examiner*—W. Glenn Edwards
*Attorney, Agent, or Firm*—Anthony N. Magistrale

[57] ABSTRACT

An aseismic support structure which includes a fixed part which is attached to a stationary floor, an equipment connection part for holding part of the equipment and a moving part coupled to the fixed part and the equipment connection part and wherein the moving part is freely movable relative to the fixed part in any direction parallel with the stationary floor and the equipment connection part is freely rotatable about the moving part. The equipment can have a caster which is held by the equipment connection part. For a weak earthquake shock, a caster lock portion of the equipment connection part locks the caster of the equipment to prevent the movement of the equipment. For a stronger earthquake, resonance is prevented by the moving part moving in a direction parallel with the stationary floor, and for a ruinous earthquake the vibration of the moving part is absorbed by a shock absorbing member attached to the fixed part.

14 Claims, 3 Drawing Sheets

ASEISMIC SUPPORT STRUCTURE

BACKGROUND OF THE INVENTION

1. Field of the invention

The present invention relates to a device for supporting a structure relative to a stationary floor and in particular, to an aseismic device which has resistance to earthquakes and can support a structure such as a computer which is sensitive to the shock and vibration of an earthquake.

2. Description of Related Art

At present, structures used for daily and industrial applications are wide ranging and include manufacturing machines, household electrical appliances, transportation equipment, etc. Some of them are particularly sensitive to the shock of an earthquake. It is the most basic object of a support structure having earthquake resistance (hereinafter referred to as aseismic support structure) to prevent the collapse of these structures when an earthquake occurs. Furthermore, equipment sensitive to the shock of an earthquake, for instance, electronic equipment, computers, measuring instruments and the like (hereinafter referred to as equipment) require that consideration be given not only to avoid destruction of their functions by the earthquake but also prevent the loss of data or a malfunction. Some of them observe the behavior during an earthquake and instantaneously perform a data calculation based on the result of the observation, and the above requirement is more severe in such equipment. Accordingly, they particularly need to be fixed to an aseismic support structure different from ordinary structures, or to a floor or the like by a highly earthquake-proof system.

An earthquake first causes a problem of the movement or turnover of equipment. The movement of equipment may cause the breakage of the connected cables or the contact with other equipment which further increases the possibility of a malfunction. Further, the turnover of equipment may physically destroy other equipment or cause an injury to workers. Moreover, the effect on the inside of the equipment by the seismic shock from the floor surface is very significant. For instance, stress may occur in parts within the equipment that can break the package or cause data errors, loss of data, or the like. In addition, there is a similar need in various production machines. If such production machines move or fall down when an earthquake occurs, the smoothness of the process is lost, which is very dangerous.

Generally speaking, since many cables are connected to the above mentioned equipment, the floor is double-structured for large-sized equipment. That is, on the stationary floor (slab) forming the bottom part, there are additionally provided free access floors at predetermined intervals, and a free wiring is secured by the use of the intervals. The inventors of the present invention disclosed a method in which a toggle bar is used to fix equipment on free access floors (Japanese Patent Application No. 7-42747). However, this method cannot cover equipment which are smaller in size and directly fixed to a stationary floor.

Conventionally, there have been several structures or methods for supporting equipment directly fixed on a stationary floor. The simplest way is to attach a caster to the equipment and place the equipment on the stationary floor. Typically, in this method, the caster is normally in a locked state because it is undesirable for the equipment to move during its normal use. The caster becomes movable if an earthquake occurs and an acceleration greater than a predetermined value is applied on the equipment, so that the energy of the earthquake is absorbed by the movement of the equipment caused by the caster. This method only requires that a caster, which is a small part, be attached to the bottom surface of the equipment, and thus it is the simplest countermeasure against earthquakes. In addition, this method is convenient for a change in the placement of equipment because the location of the equipment is not fixed. However, the maximum earthquake resistance of this method is about 0.4 G, which is low, and thus it cannot hold up under a large earthquake which produces a serious problem for the equipment. Furthermore, since there are problems of stress generation on the cables due to the movement of the equipment, and the turnover of the equipment, it is not appropriate as an aseismic supporting method. As an improved method, there is a method in which a pad is attached to the caster, and a method in which the equipment is fixed to a stationary floor by means of an adsorption disk, but these are also essentially insufficient from the viewpoint of resistance to earthquakes.

As a method for increasing resistance to earthquakes, there is a method in which equipment is directly fixed to a stationary floor (slab) or free access floor by means such as bolts. The former is also called a direct support type, while the latter is called an indirect support type. The direct support type can resist an acceleration greater than 1 G as earthquake resistance, and has an advantage that the movement and turnover of equipment does not occur. On the other hand, however, since the equipment is difficult to move once they are fixed, a long-term plan for the placement layout is required and the costs for the placement (e.g. construction cost) are also high. In addition, since the earthquake energy directly propagates through the stationary floor, a problem such as a malfunction is likely to occur in this method.

Accordingly, there is a desire for an aseismic support structure which provides sufficient earthquake resistance, overcomes the disadvantages of the above described structures and methods and is applicable to existing equipment.

It is an object of the present invention to provide an aseismic support structure which prevents equipment installed on a stationary floor from falling down or moving when an earthquake occurs. Further it is an object of the present invention to provide an aseismic support structure having earthquake resistance greater than 1 G and can suppress the seismic effect on equipment to a minimum.

Moreover, it is an object of the present invention to provide an aseismic support structure and system which is also applicable to existing equipment, requires no modification of the room where the equipment is installed and does not inhibit transferring or moving the equipment after installation.

SUMMARY OF THE INVENTION

The above objects of the present invention are achieved by an aseismic support structure having a fixed part which is fixed to a stationary floor, a moving part coupled to the fixed part and moving in any direction parallel with regard to the stationary floor, and an equipment connection part coupled to the moving part and to be connected to the equipment installed on the stationary floor. Specifically, in this aseismic support structure, the effect on the equipment is kept to a minimum by absorbing a shock in different ways depending on the degree of the shock. That is, for a weak earthquake and a medium earthquake, the shock is absorbed by the movement of the moving part in a direction parallel to the stationary floor, and for a strong earthquake, the shock given to the moving part is absorbed by the shock absorbing means attached to the fixed part. Also, in an extremely strong or ruinous earthquake, the turnover of the equipment can be prevented because of the fixed part being fixed to the stationary floor.

The present invention provides several advantages including satisfying quake resistance of 1000 gal and is capable of absorbing the seismic effect on the equipment installed on a stationary floor. In addition, no high facility and construction cost are needed for installation of the aseismic support structure of the present invention. Moreover, it is applicable to existing equipment and does not inhibit the transfer or movement of equipment after installation.

DETAILED DESCRIPTION OF THE INVENTION

Figure 3:
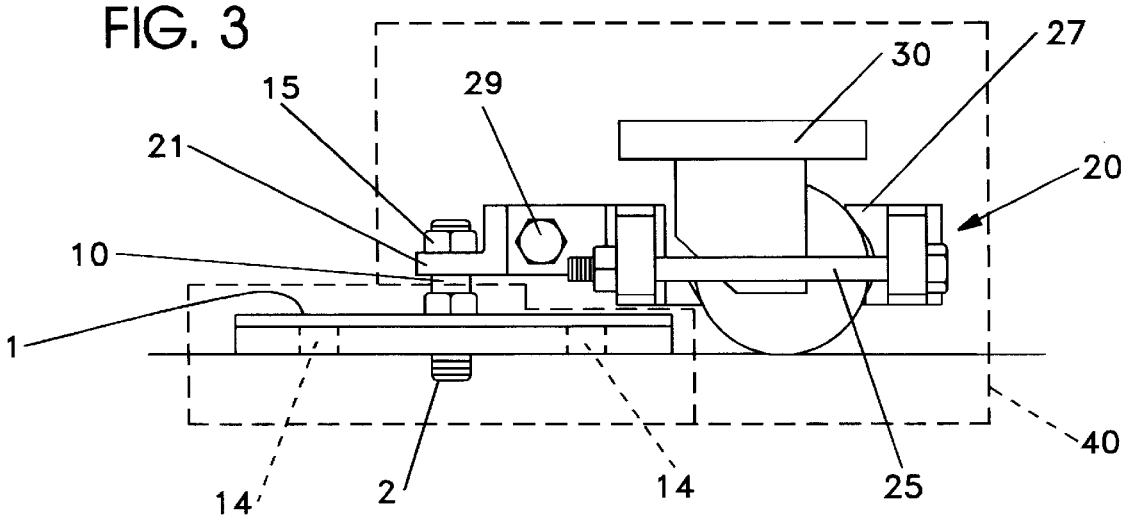
FIG. 3 is a side view of the aseismic support structure according to the present invention.
Figure 4:
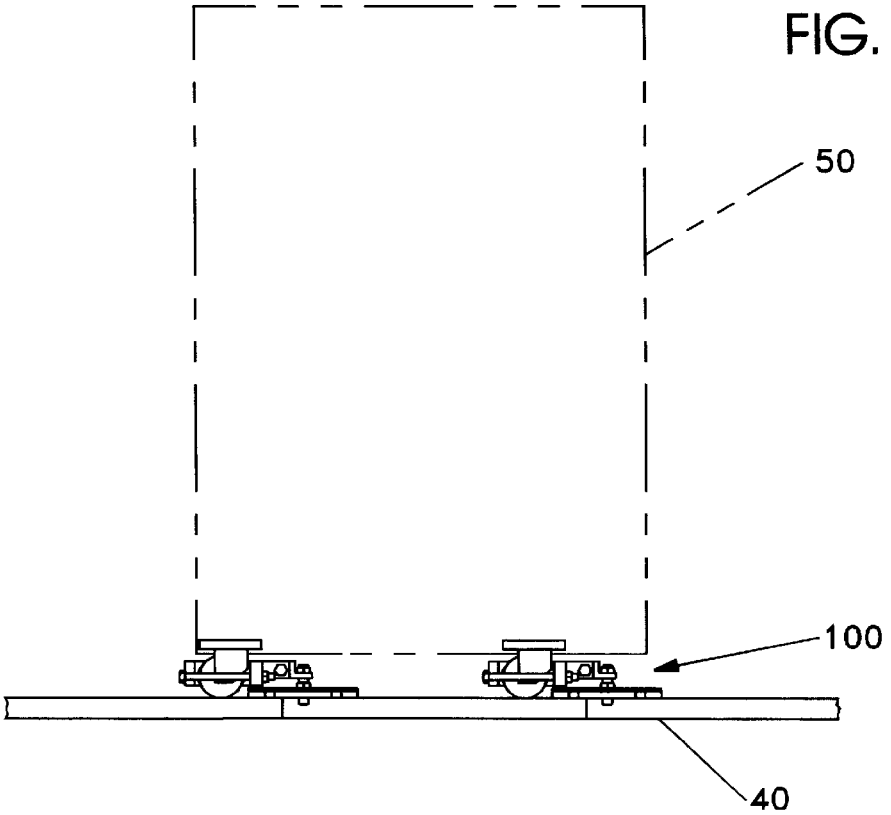
FIG. 4 is an example of an application of the aseismic support structure to equipment according to the present invention.

FIG. 4 shows the connection of a stationary floor 40 and equipment 50 by an aseismic support structure 100 of the present invention. The present invention prevents the movement and turnover of equipment 50 installed on the stationary floor 40. The specific construction and operation of the aseismic support structure 100 are described below with reference to FIGS. 1 to 3.

Figure 1:
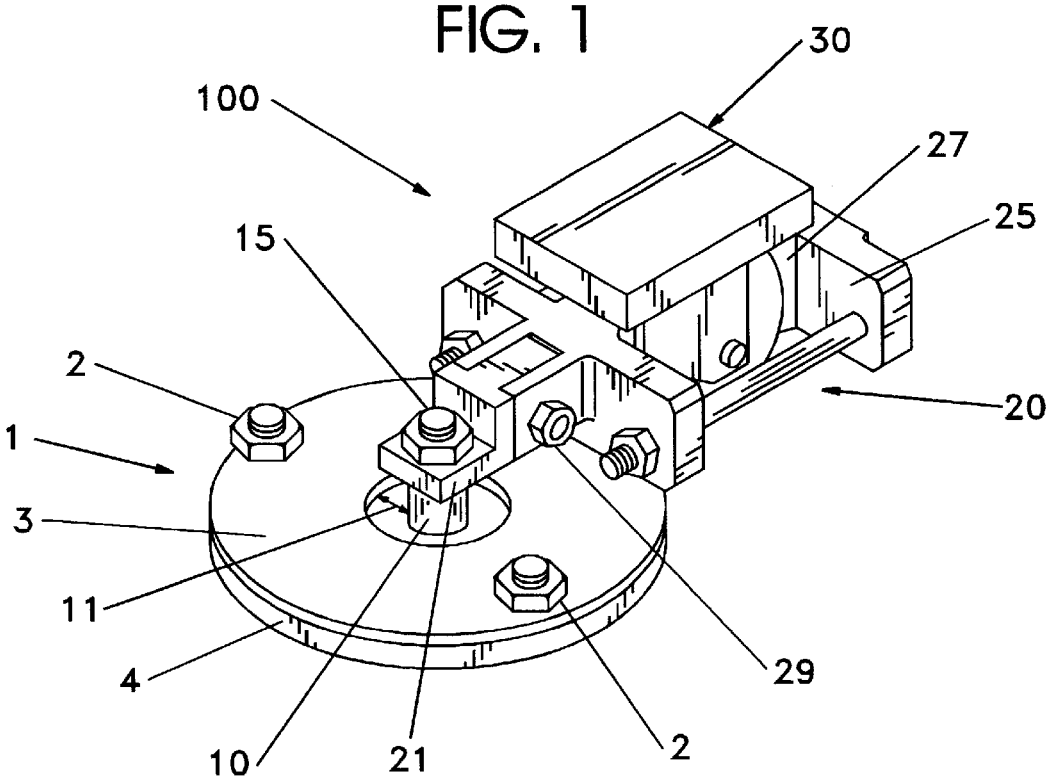
FIG. 1 is a schematic diagram showing a top perspective view of the aseismic support structure according to the present invention.

In FIG. 1, an embodiment of the aseismic support structure of the present invention is shown. As shown therein, the aseismic support structure 100 comprises three main parts: a fixed part 1, a moving part 10, and an equipment connection part 20. Although a caster 30 is part of the equipment and is not part of the aseismic support structure 100, it is depicted for convenience in showing the connection between the aseismic support structure 100 and the equipment 50.

The fixed part 1 is preferably shaped in a disk, and fixed to the stationary floor by means such as bolts 2. This provides a structure to prevent the equipment from being turned over by a very strong earthquake. Although the bolts 2 are provided at two positions, the number of bolts can be increased to more than two depending on the expected seismic intensity. Also, the shape of the fixed part 1 need not always be a disk and can be any suitable shape. The fixed part 1 comprises a cover 3 and an outer ring portion 4.

The moving part 10 is connected to the fixed part 1 and it is represented by a shaft standing in a direction vertical to the stationary floor. The moving part 10 first needs to couple the fixed part 1 and the equipment connection part 20, and second needs to be movable in a predetermined range relative to the fixed part 1 and in any direction parallel with the stationary floor. By enabling the moving part 10 to be movable as such, the direct propagation of the acceleration of an earthquake to the equipment can be prevented. Thus, the equipment is prevented from resonating with the shock of the earthquake. In order that the moving part 10 is movable in a predetermined range relative to the fixed part 1, a predetermined gap 11 is provided between the two. This gap can be adjusted according to the amplitude of the earthquake but if too small, the shock of the earthquake directly propagates to the equipment, which is inappropriate. If the gap 11 is too large, the vibration amplitude of the equipment during the earthquake is so large that it adversely affects the equipment. To avoid being too small or too large the gap 11 is preferably in the range of about 10 to 20 mm. This is a value derived from the amplitudes of earthquakes which have so far been observed. In addition, since the shock of an earthquake does not regularly occur in a predetermined direction, it is required that the moving part 10 must evenly move in any direction. To this end, it is desirable that the moving part 10 be a cylindrically shaped shaft, and it is also desirable that the cover 3 have a circular opening fitted to the sectional shape of the moving part 10.

The moving part 10 is preferably coupled to the fixed part 1 with a friction coefficient of a predetermined value. If this friction coefficient is too small, the above described action of reducing the shock would be lost, and the structure may be inappropriate for an aseismic support. Further, if the friction coefficient is too large, the vibration of the fixed part directly propagates to the equipment, which is also inappropriate. The friction coefficient is preferably about 0.4 to 1.2.

Figure 2:
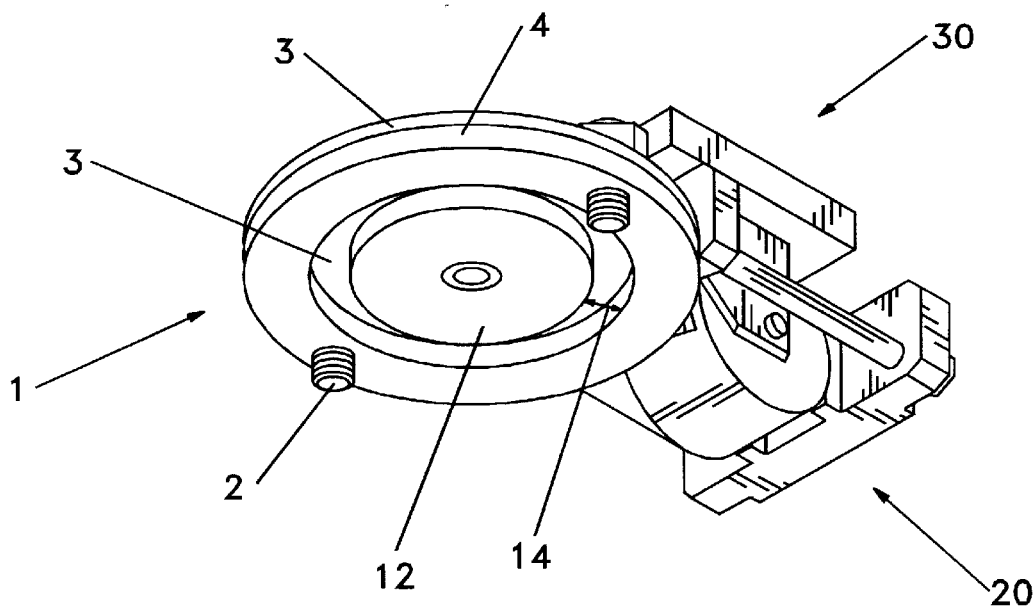
FIG. 2 is a schematic diagram showing a bottom perspective view of the aseismic support structure according to the present subject invention.

FIG. 2 shows the aseismic structure 100 of FIG. 1 as seen from the bottom. The friction coefficient is given by a plate 12 which is fitted to the moving part 10 and in contact with the bottom of the fixed part 1. The outer periphery of the plate 12 is opposed to the inner periphery of the outer ring portion 4 of the fixed part 1 with a predetermined distance 14 between them. In addition, the friction coefficient may be given by the friction between the plate 12 and the stationary floor.

In principle, the distance 11 ($I_1$) between the moving part 10 and the cover 3 and the distance 14 ($I_2$) between the outer periphery of the plate 12 and the inner periphery of the outer ring portion 4 of the fixed part 1 are the same. However, considering that the shock to the equipment by a ruinous earthquake having an amplitude exceeding the distances $I_1$ and $I_2$ is absorbed by the shock absorbing member built in the outer ring portion 4, $I_1>I_2$ is preferable. Conversely, if the shock absorbing member is provided on the cover 3, $I_1<I_2$ is preferable. In general, the difference between the $I_1$ and $I_2$ distances is the contraction distance of the shock absorbing member due to the shock, and its value is in the order of 1 to 7 mm.

Figure 5:
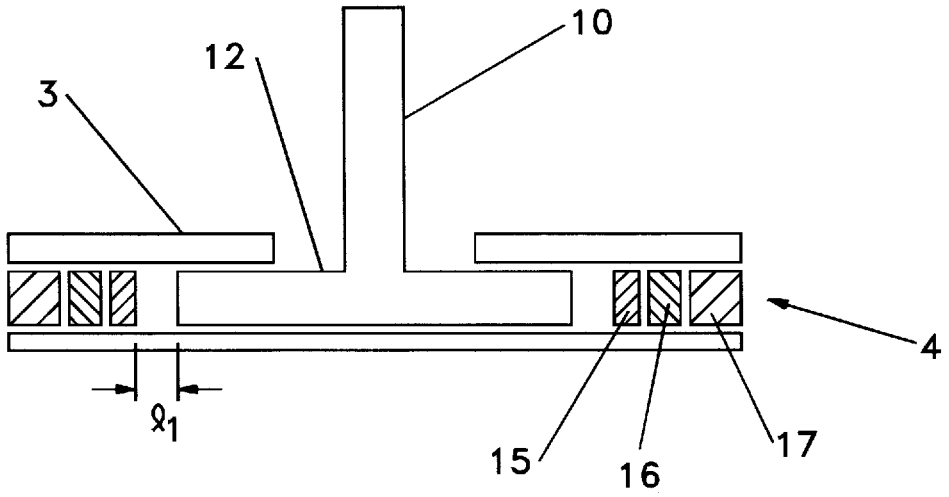
FIG. 5 is a sectional view of part of the aseismic support structure according to the present invention.

A cross sectional view of the shock absorbing member provided on the outer ring portion 4 is shown in FIG. 5. The shock absorbing member is generally of a deformable material. For instance, the outermost part of the outer ring portion 4 is formed of a steel part 17, inside which an aluminum part 16 is disposed, and for the innermost part which is to be put into contact with the plate part 12, a lining of rubber 15 is provided. There is a distance of $I_1$ between the plate part 12 and the rubber part 15 having a shock absorbing function. $I_1$ is about 15 mm according to this embodiment. The whole plate part 12 may be made of hard rubber or organic resin which has good wear resistance.

Referring again to FIGS. 1 and 2, the equipment connection part 20 has a function of connecting with part of the equipment. The connection part 20 comprises a #-shaped portion 25 into which the caster 30 is entirely fitted. The part of the equipment with which the equipment connection part 20 connects need not always be a caster 30. For example, it is possible that a projecting portion is provided from a part of the equipment and the equipment connection part 20 has a structure to be fixed to the projecting portion. However, for the caster 30, by providing a caster lock part 27 in the equipment connection part 20, elaborate countermeasures against earthquakes can be taken according to the shock. That is, for weak tremors, through fixing the caster 30 by the use of the caster lock part 27, the movement and vibration of the equipment are prevented by the static frictional force between the caster 30 and the stationary floor. The caster lock part 27 will be made clear, as described later with reference to FIG. 3.

The equipment connection part 20 is connected in a manner in which it can freely rotate around the moving part 10. A bolt 15 is provided on the top of the moving part 10 and connected to one end 21 of the equipment connection part 20. The above manner allowing such free rotation is required to enable the irregular shock of an earthquake to be dealt with while producing no undesirable internal stress.

In addition, the #-shaped portion 25 and one end 21 of the equipment connection part 20 are connected by a bolt 29 in a manner in which the equipment connection part 20 can have any angle with the stationary floor. This is to reduce the direct propagation of the vertical vibration by an earthquake to the equipment. Such idea is the same as the point that the moving part 10 can freely move in a predetermined range relative to the fixed part 1 in any direction parallel with the stationary floor. However, the movement in any direction parallel with the stationary floor is based on the assumption that there will be a rolling.

FIG. 3 shows a side sectional view of the aseismic support structure 100. As noted above, the aseismic support structure 100 is installed on the stationary floor 40, and the fixed part 1 comprises a cover 3 and an outer ring portion 4, which is fixed to the floor surface by anchor bolts 2. The moving part 10 (shaft) is coupled to the fixed part 1. The moving part 10 connects the fixed part 1 to the equipment connection part 20, reduces the vibration of the floor (fixed part) and prevents it from propagating to the equipment connection part 20. The top of the moving part 10 is coupled to one end 21 of the equipment connection part 20 by a bolt 15. One end 21 of the equipment connection part 20 and the #-shaped portion 25 thereof are connected by a bolt 29 so that the #-shaped portion 25 can rotate at any angle with the floor surface 40. Further, if the equipment connection part 20 is connected to the caster 30 of equipment, a caster lock part 27 is provided in the #-shaped portion 25. The caster lock part 27 prevents the rotation of the caster 30 to prevent the movement of the equipment during an earthquake.

The aseismic support structure 100 of the present invention can achieve earthquake resistance through the following operations.

(1) For a weak shock, the movement and vibration of equipment can be prevented by the static frictional force between the caster 30 and the floor surface by locking the caster 30 with the caster lock part 27.

(2) For a medium shock exceeding the static frictional force by the caster lock part 27, the moving part 10 absorbs the shock. The moving part 10 can move within the length of the gap $I_1$ or $I_2$ provided between the fixed part 1. This enables the prevention of resonance of the equipment due to the vibration of the stationary floor.

(3) Even for such a shock as causing a movement exceeding the above $I_1$ or $I_2$, the shock given to the moving part can be absorbed by the shock absorbing member attached to the fixed part. This significantly reduces the shock transmitted to the equipment.

(4) Even if an intense shock is observed, the turnover of equipment can be prevented because the fixed part 1 is fixed to the stationary floor 40 and the equipment connection part 20 connected to the fixed floor 1 is steadily connected to the equipment.

In addition, applying the aseismic support structure 100 to the equipment requires only two steps: (1) fixing the fixed part 1 of the aseismic support structure to the stationary floor, and (2) connecting and fixing the equipment connection part 20 of the aseismic support structure to the equipment. Accordingly, no extensive construction such as improvement of the stationary floor itself to an aseismic structure is required. Furthermore, since this aseismic support structure 100 can also apply to existing equipment, it is not needed to consider earthquake resistance when the stationary floor is designed. This further means that rearrangement such as change in the placement of equipment can very easily be conducted even after the aseismic support structure is applied to the equipment. Again, as described in the above two steps, to apply the aseismic support structure 100 to the equipment can be performed by very simple steps in itself.

Earthquake resistance was experimentally evaluated for the equipment installed by using the aseismic support structure 100 of the present invention and for the equipment installed only by fixing it to a stationary floor. In the experiment, the same acceleration waveform as an actual earthquake was applied to the equipment, and the acceleration measured by an accelerometer mounted within the equipment as well as the conditions of the equipment such as the movement and turnover of the equipment were observed.

Figure 6:
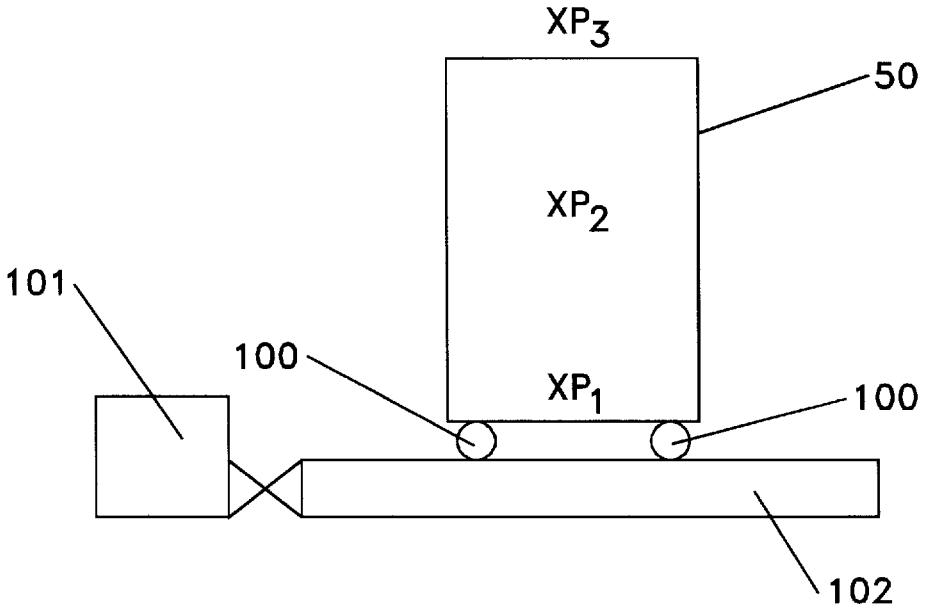
FIG. 6 is a schematic diagram showing an apparatus for testing the aseismic support structure according to the present invention.

FIG. 6 shows how the experiment was made. Equipment 50 was connected to a shaking table 102 through the aseismic support structure 100 of the present invention. The shaking table 102 is given a desired acceleration by a shaker 101. The accelerations observed at three points on the equipment 50 and the ratios of the input accelerations and the observed accelerations (amplification factor) are shown in Table 1. As the three observation points, the bottom of the equipment (PI), the center of the equipment (P2) and the top of the equipment (P3) were selected.

TABLE 1

| | Observed acceleration (upper)/ Amplification factor (lower) | | |
|---|---|---|---|
| Input acceleration | P1 | P2 | P3 |
| 0.3G | 0.86 | 1.74 | 1.21 |
| | (2.9) | (5.8) | (4.0) |
| 0.5G | 0.84 | 3.14 | 3.06 |
| | (1.0) | (6.3) | (6.0) |

It is generally considered that, in equipment having no provision against earthquakes, the input acceleration by an earthquake is amplified by 10 to 20 times. The maximum amplification factors of the equipment fixed by the aseismic support structure 100 of the present invention are 5.8 (0.3 G) and 6.3 (0.5 G), which are significantly lower values as compared with equipment having no provision against earthquakes.

Further, no movement or turnover of the equipment was observed in the experiment. Also in this respect, the aseismic support structure 100 was evaluated in the point that it has a certain action and effect.

In accordance with the aseismic support structure according to the present invention, the following advantages are produced.

(1) It is possible to absorb the effect of an earthquake on equipment installed on a stationary floor.

(2) Earthquake resistance of 1000 gal is satisfied.

(3) The aseismic support structure requires no large facility and construction costs when it is attached, and is applicable to existing equipment.

(4) Even after the installation, the transfer or movement of the equipment is not inhibited, thus enabling a change of the placement of the equipment.

What is claimed is:

1. An aseismic support structure for connecting equipment installed on a stationary floor to said stationary floor, said aseismic support structure comprising:

a first part which is attached to said stationary floor, a second part for holding part of said equipment, a moving part coupled to said first part and said second part, said moving part being movable in a predetermined range relative to said first part in any direction parallel with said stationary floor, wherein said moving part includes a shaft fitted with a substantially disk shaped plate having top and bottom circular surfaces and a circular outer surface, a substantial portion of said top surface of said plate being in contact with said first part to provide a predetermined friction coefficient between said first part and said plate, wherein said first part is a substantially disk shaped cover with a circular opening at its center and an outer ring attached to a bottom of said cover, wherein an inner periphery of said outer ring is spaced from said circular outer surface of said plate by a first predetermined distance, said plate moving laterally to cause said circular outer surface to be put in contact with said inner periphery of said outer ring, and said second part being freely rotatable both vertically and horizontally about said moving part.

2. The aseismic support structure of claim 1, wherein said equipment includes a caster and said second part holds said caster.

3. The aseismic support structure of claim 2, wherein said second part has a part for braking the rotation of said caster.

4. The aseismic support structure of claim 1, wherein said friction coefficient is in a range of 0.4 to 1.2.

5. The aseismic support structure of claim 1, wherein said second part is movable to have any angle with regard to said stationary floor.

6. The aseismic support structure of claim 1, wherein said first part includes at least two securing elements for attaching said disk to said stationary floor.

7. The aseismic support structure of claim 1, wherein said outer ring of said first part is a shock absorbing member.

8. The aseismic support structure of claim 1, wherein said shaft is spaced from a periphery of said circular opening in said first part with a second predetermined distance, said first and second predetermined distances being greater than zero and of sufficient size to withstand an earthquake.

9. The aseismic support structure of claim 8, wherein said first and second predetermined distances are substantially equal and are in a range of between 10 to 20 mm.

10. The aseismic support structure of claim 8, wherein a difference between said first and second predetermined distances is in a range of between 1 and 7 mm.

11. The aseismic support structure of claim 7, wherein the acceleration of an earthquake is reduced by the movement of said moving part in any direction parallel with said stationary floor, or by the contact between said shock absorbing member attached to said fixed part and said circular outer surface of said plate, depending on the degree of shock.

12. The aseismic support structure of claim 11, wherein said equipment includes a caster and said second part holds said caster, wherein the movement of the equipment is prevented at a predetermined degree of shock by braking the caster related to the equipment.

13. The aseismic support structure of claim 11, wherein the turnover of the equipment is prevented at a predetermined degree of shock by said fixed part being fixed to the stationary floor.

14. The aseismic support structure of claim 1, wherein said cover includes top and bottom circular surfaces and wherein said substantial portion of said top surface of said plate is in contact with a substantial portion of said bottom circular surface of said cover to provide said predetermined friction coefficient between said first part and said plate.

* * * * *